US012108856B1

(12) United States Patent
Cottrell

(10) Patent No.: US 12,108,856 B1
(45) Date of Patent: Oct. 8, 2024

(54) METHOD FOR CONSTRUCTING AN ELEVATED BEARD-RINSING SYSTEM

(71) Applicant: Roger Cottrell, Sonora, KY (US)

(72) Inventor: Roger Cottrell, Sonora, KY (US)

( * ) Notice: Subject to any disclaimer, the term of this patent is extended or adjusted under 35 U.S.C. 154(b) by 0 days.

(21) Appl. No.: 18/444,741

(22) Filed: Feb. 18, 2024

(51) Int. Cl.
*A45D 19/08* (2006.01)
*E03C 1/326* (2006.01)

(52) U.S. Cl.
CPC ..... *A45D 19/08* (2013.01); *E03C 1/326* (2013.01)

(58) Field of Classification Search
CPC ..... A45D 19/08; E03C 1/326
See application file for complete search history.

(56) References Cited

U.S. PATENT DOCUMENTS 5,007,118 A * 4/1991 Ebersole ..... A61G 5/104 4/523
11,725,371 B2 * 8/2023 Tyler ..... E03C 1/22 4/689

* cited by examiner

*Primary Examiner* — Rick K Chang
(74) *Attorney, Agent, or Firm* — Chris Tanner; BlueCollarIP.com

(57) ABSTRACT

A method for constructing an upraised (elevated) sink system for beard rinsing is disclosed. The system is comfortable for both the client and also the stylist. The system eliminates bending over for the barber partly through constructing a rinse bowl to work somewhat like a shampoo bowl used by stylists use. Using the method for constructing, a system is constructed in which there is no leakage or dripping such as on new clothes or a new shirt. Using the method for constructing, the system tilts back and forth, and the height of the system is adjustable. The system is also constructed with a drain within the rinse bowl as well as a tilt-adjustment, vacuum breaker, and a spray nozzle.

3 Claims, 25 Drawing Sheets

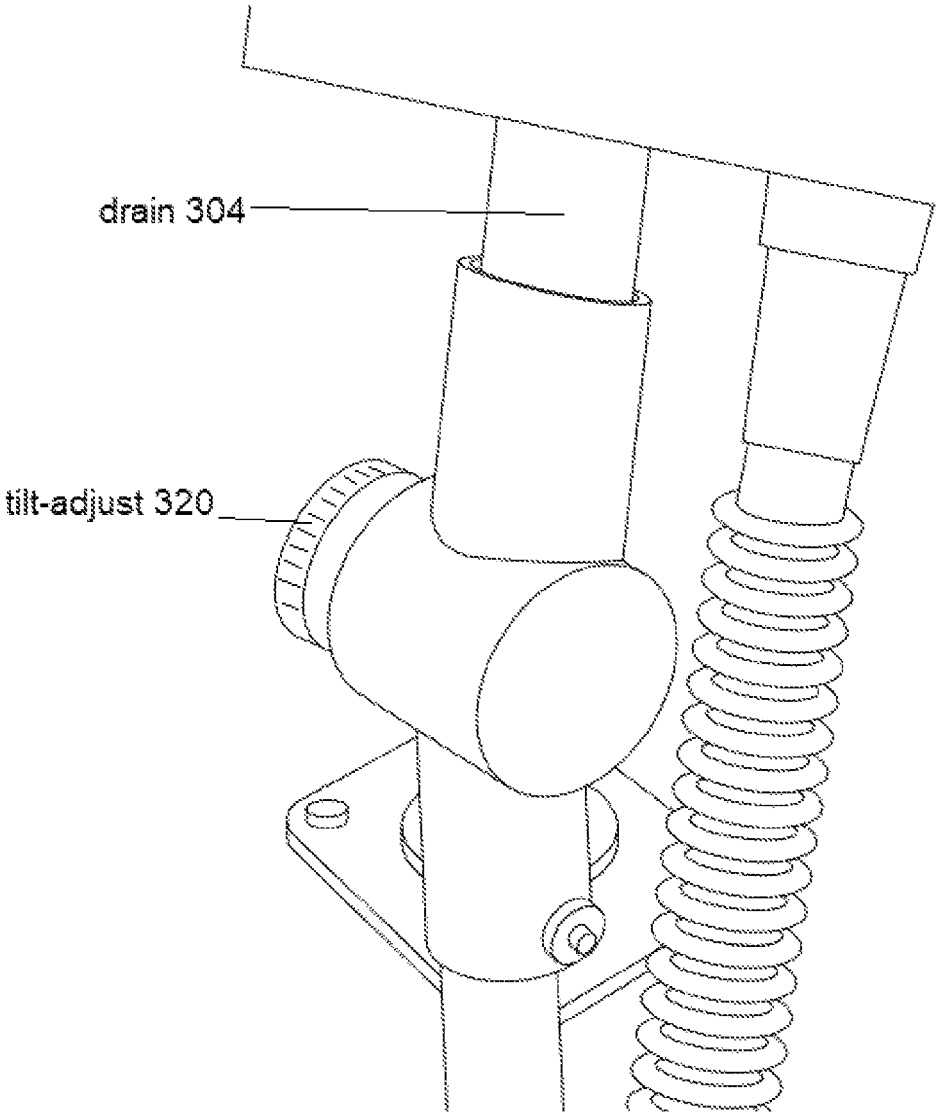
FIG. 3 (tilt-adjust)

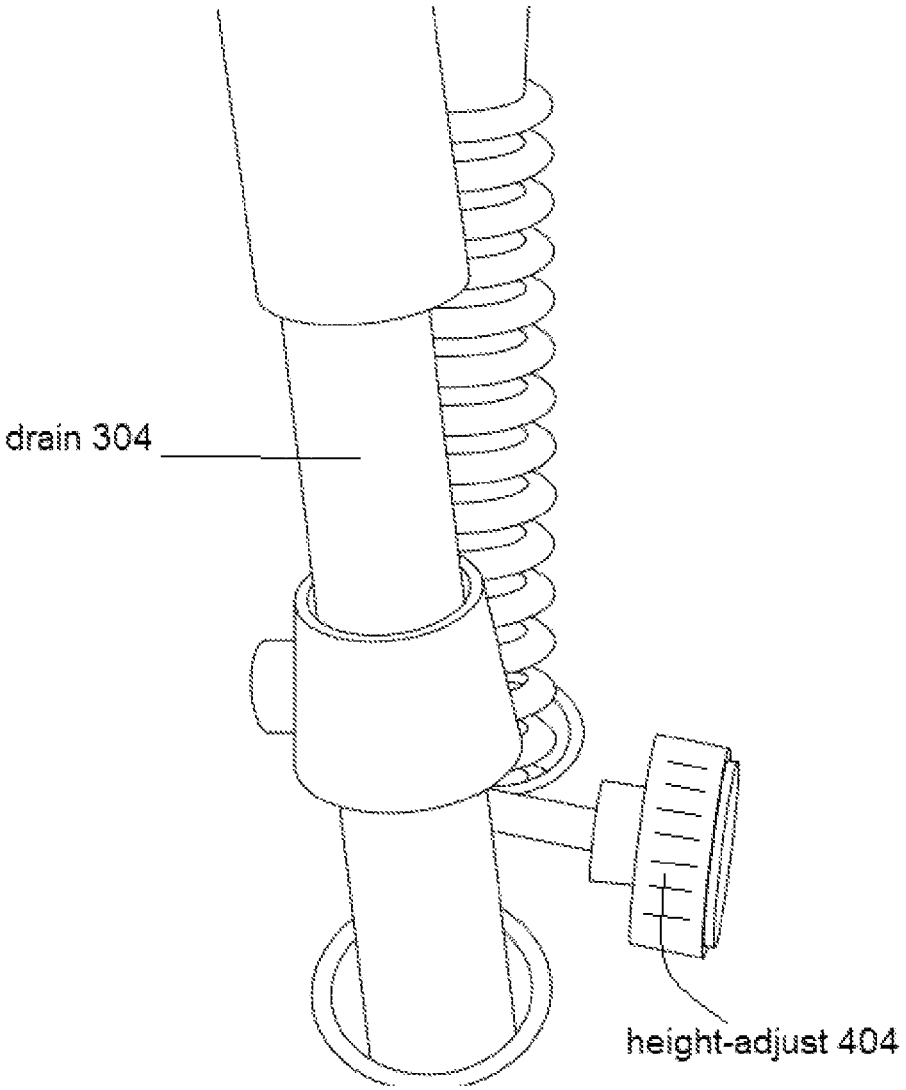
FIG. 4 (height-adjust)

FIG. 7 (user-view)

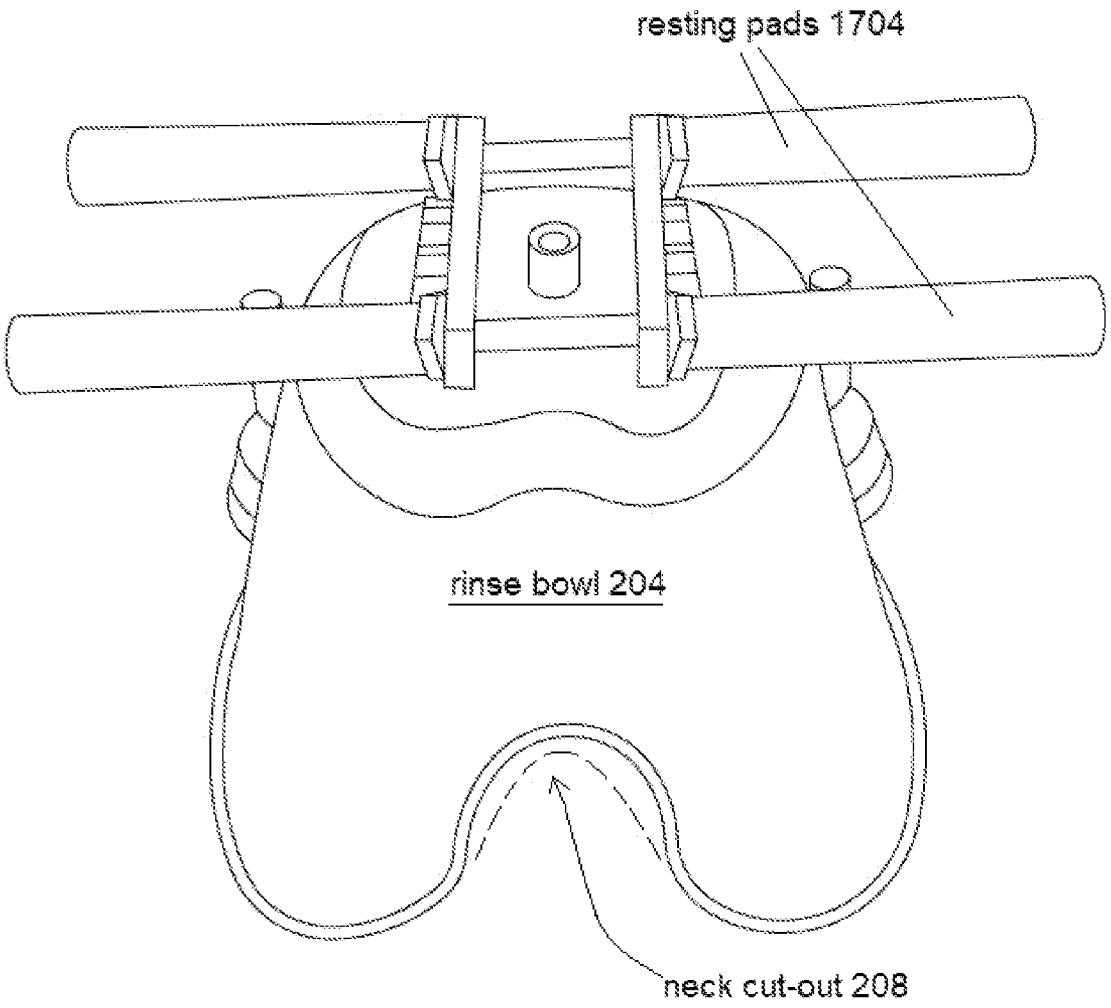
FIG. 17A (portable moveble version)

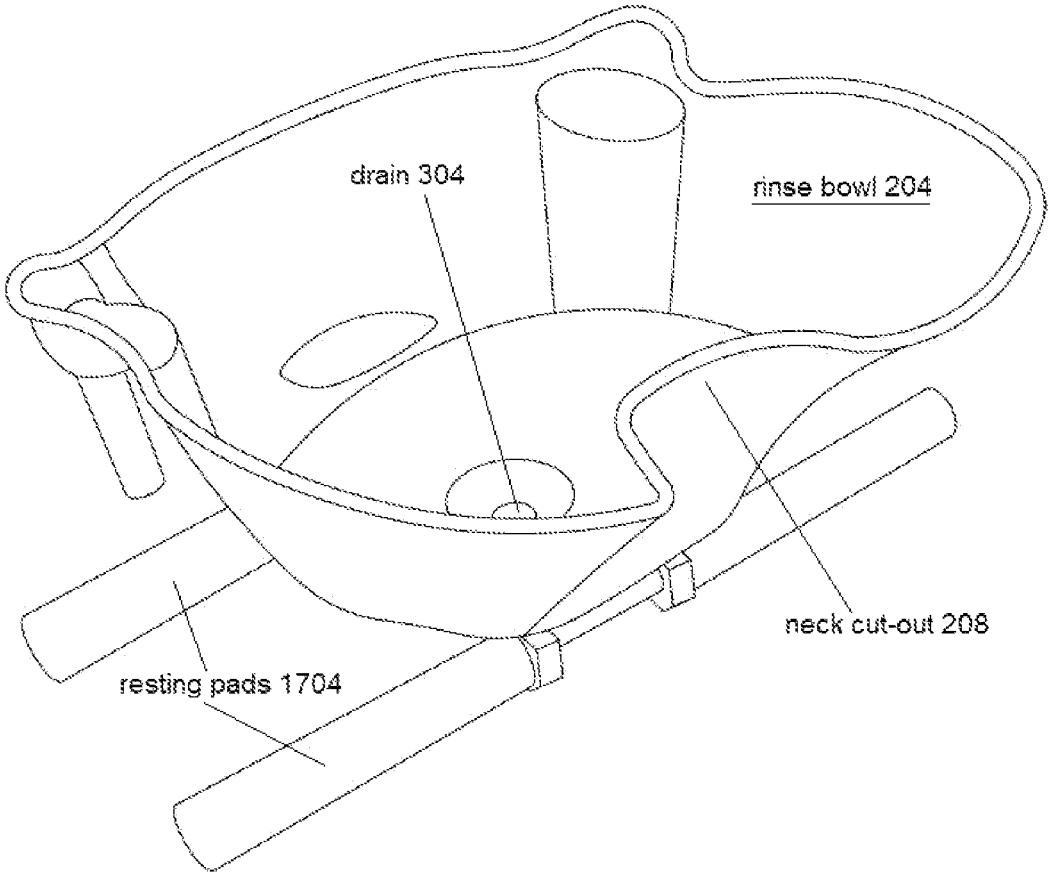
FIG. 17B (portable moveble version)

METHOD FOR CONSTRUCTING AN ELEVATED BEARD-RINSING SYSTEM

SUMMARY OF THE INVENTION

The embodiments herein comprise a sink/drain apparatus for working with bearded customers while standing.

BACKGROUND OF THE INVENTION

In a typical barbershop, rinsing and/or shampooing beard after dying can be difficult. Rinsing and shampooing a beard is difficult, requires bending over for both the stylist as well as bearded customer, can be hard on the back, and also can be difficult to rinse the color out after dyeing. The bearded customer must lean over a low sink, bend his back, and stand there a long time. Plus, even then, some excess beard-coloring can still drip down even 50 min later, thus potentially ruining a good shirt. Consequently, an improved beard rinsing mechanism is desired.

BRIEF DESCRIPTION OF THE DRAWINGS

FIGS. 3 and 5 shows underside views of a drain attached to a rinse bowl;

FIG. 4 shows the drain along with a height-adjustment mechanism;

FIGS. 17A-17B show a portable configuration of a rinse bowl that can be moved around.

DETAILED DESCRIPTION OF PREFERRED EMBODIMENTS

Traditionally, barbers get many requests for beard coloring but until now had no easy way of rinsing or shampooing afterwards without risking a messy outcome. To address these and other issues, an example upraised sink system 100 for more effective barbering is shown at least within FIGS. 1A, 1B, 2A, and 2B. The system 100 is comfortable for both the client and also the stylist. FIGS. 2A and 2B show the system in an example usage.

A typical professional beard-coloring dye does not "run" too badly, but is still a liquid, and thus can still flow downward to unwanted places, similar to hair coloring that's applied on the scalp. Thus, the beard dye must also be rinsed and shampooed properly.

At present, performing a beard-related task can be back-bending and uncomfortable for both stylist (barber) and bearded customer. Also, portions of a customer's beard are downward-facing and thus inaccessible. That's why beard rinsing isn't offered and often avoided. However, that does not mean no need exists, instead that means stylists have not properly contemplated how to resolve this issue. Instead, they may have the bearded customer perhaps wear a bib, or just finish the dyeing, not rinse, and then say "OK, good luck getting yourself cleaned up".

Using the upraised system(s) 100 described herein, there is no bending over for the barber. Instead, both can stand up straight. The rinse bowl 204 works like a shampoo bowl that stylists use to shampoo or color a customer's hair. Using the system, there is no leakage or dripping such as on new clothes or a new shirt. Another advantage is that rinse time is much shorter.

Using the upraised sink system 100 described herein, if the beard color is rinsed well, then shampooed properly, the system ensures all rinsing by-products are removed and there is no way for any unwanted dyes, shampoos, or water to get onto a customer's clothing.

Figure 1A:
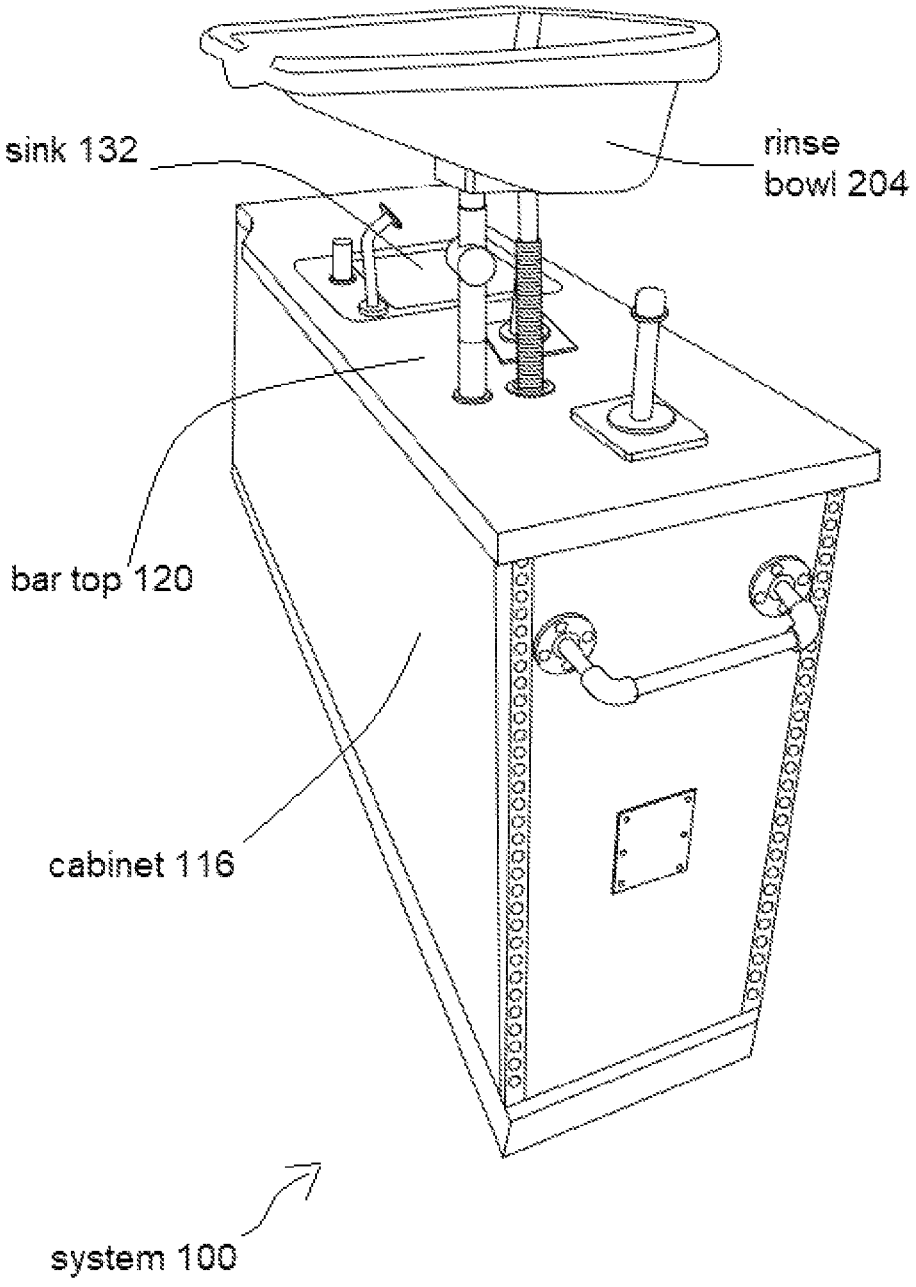
FIGS. 1A and 1B show exemplary embodiments of a system described herein.
Figure 1B:
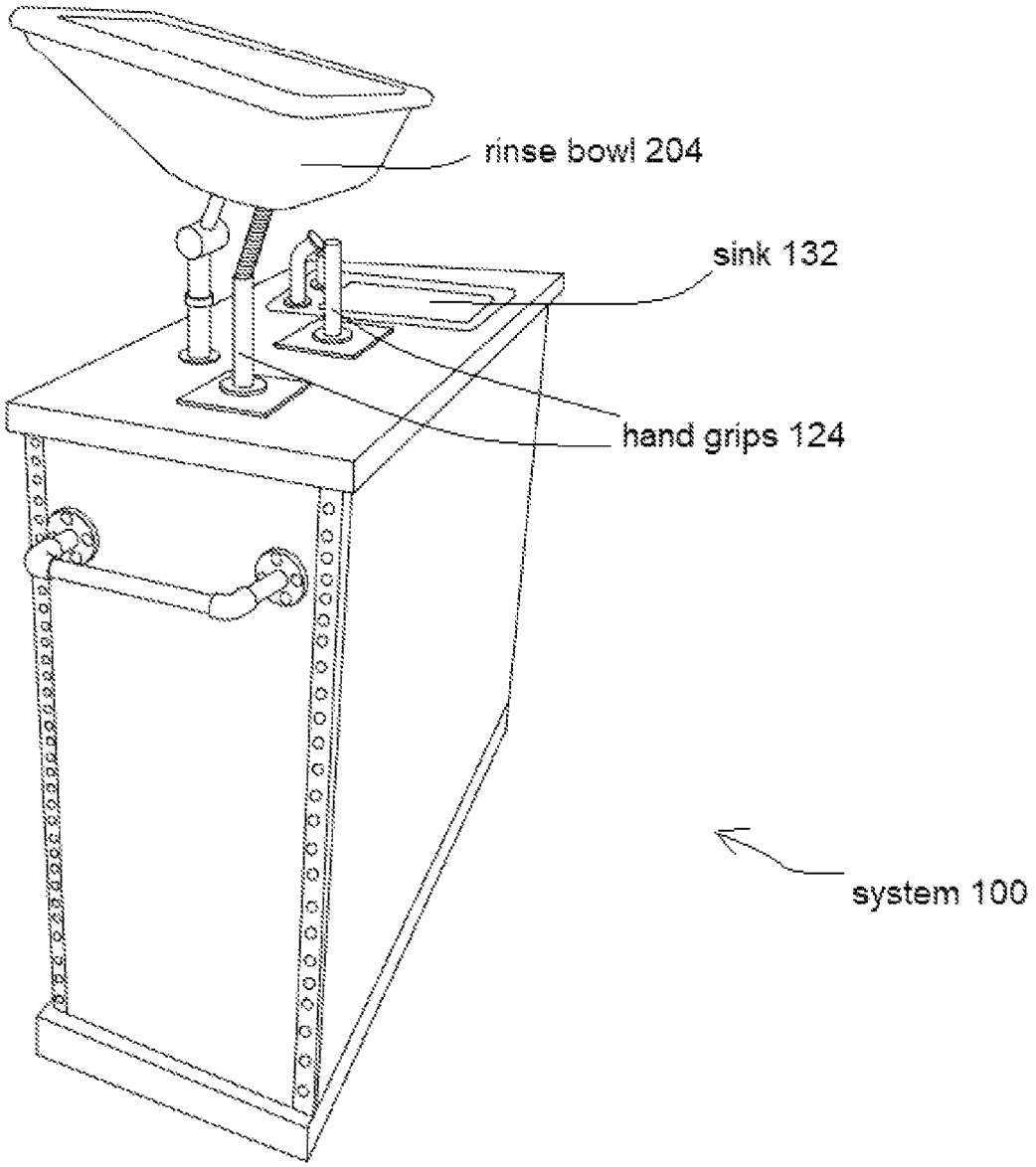
Figure 2A:
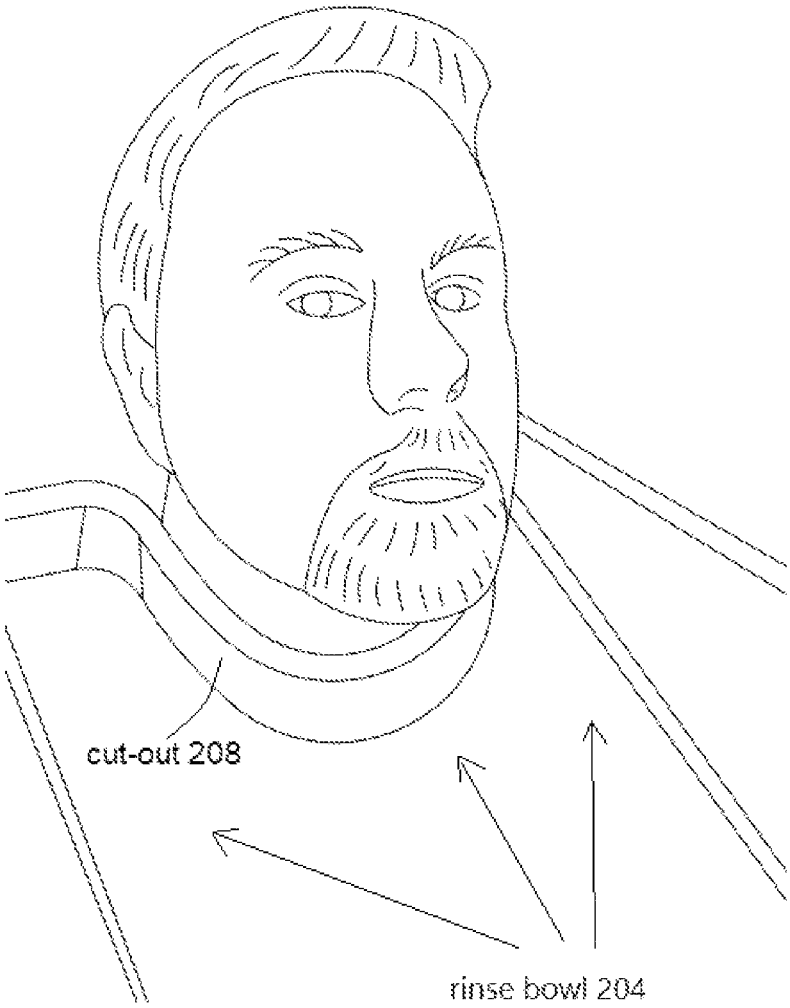
FIGS. 2A and 2B show a bearded customer sitting within the exemplary embodiments of FIGS. 1A and 1B.
Figure 2B:
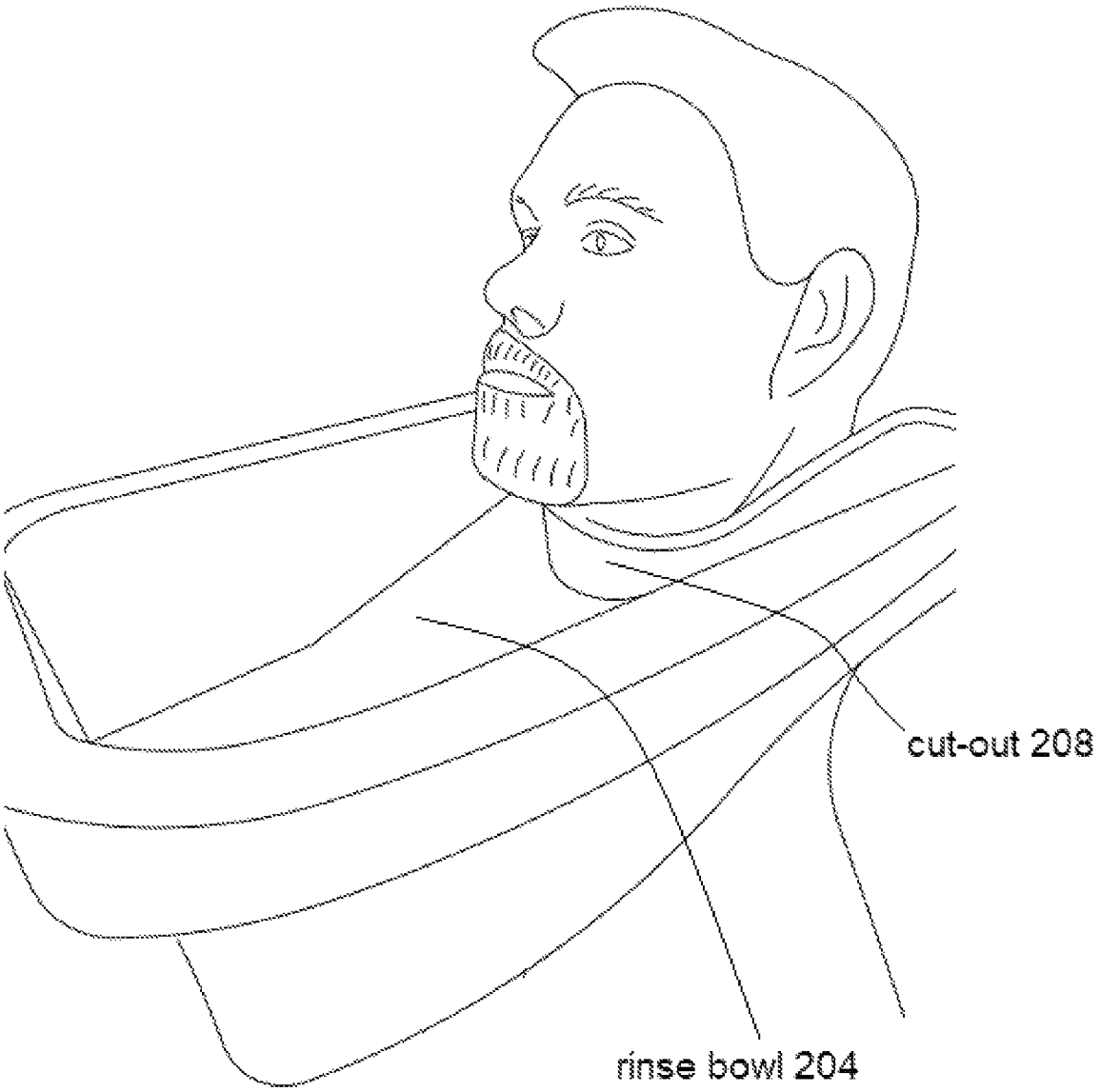

From FIGS. 1A and 1B it should be apparent that the system 100 comprises at least a rinse bowl 204 having a cut-out 208 for a neck, a spray nozzle 604, hand grips 124, height-adjustment 404, and tilt-adjustment 320. Further, the neck cutout 208 provides a non-awkward/convenient rest area during washing. The natural groove provides room for the chest area to stay close to the rinse bowl 204.

The system 100 also tilts back and forth, as shown at least within FIG. 3 (tilt-adjustment). The height of the system 100 is adjustable, as shown at least within FIG. 4.

Figure 5:
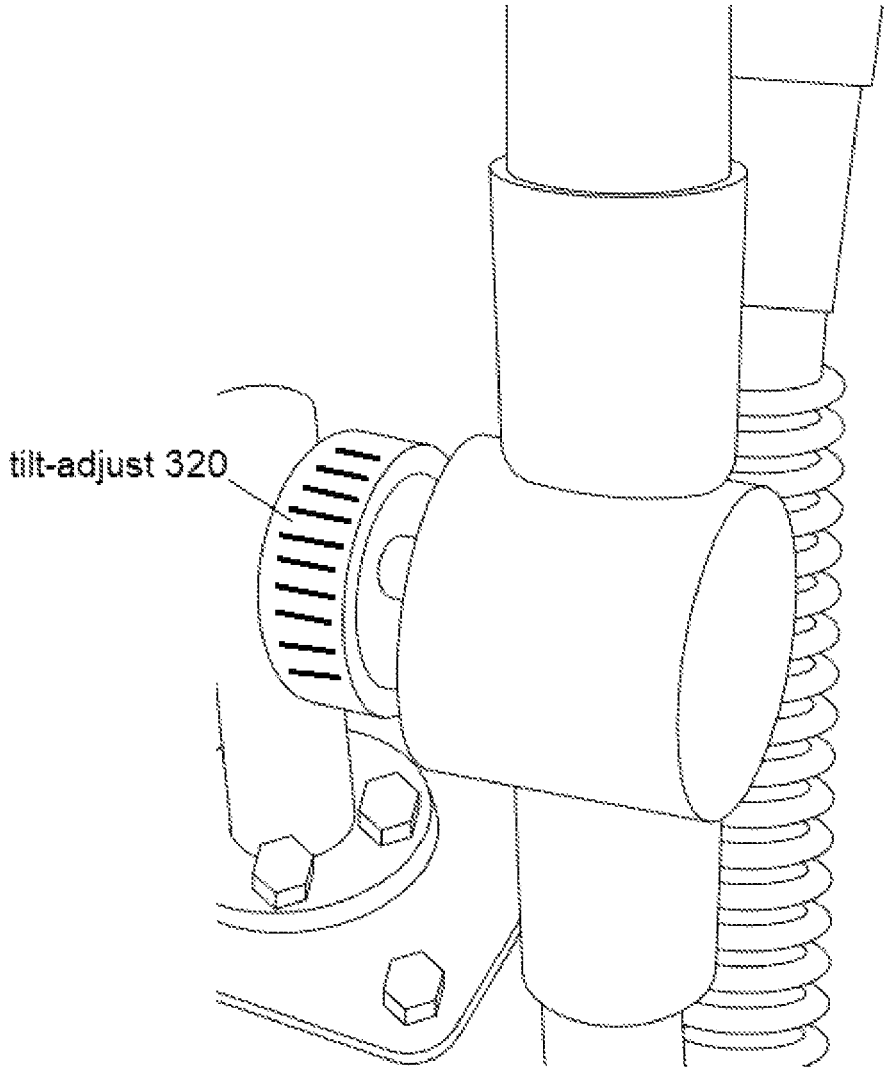
Figure 6:
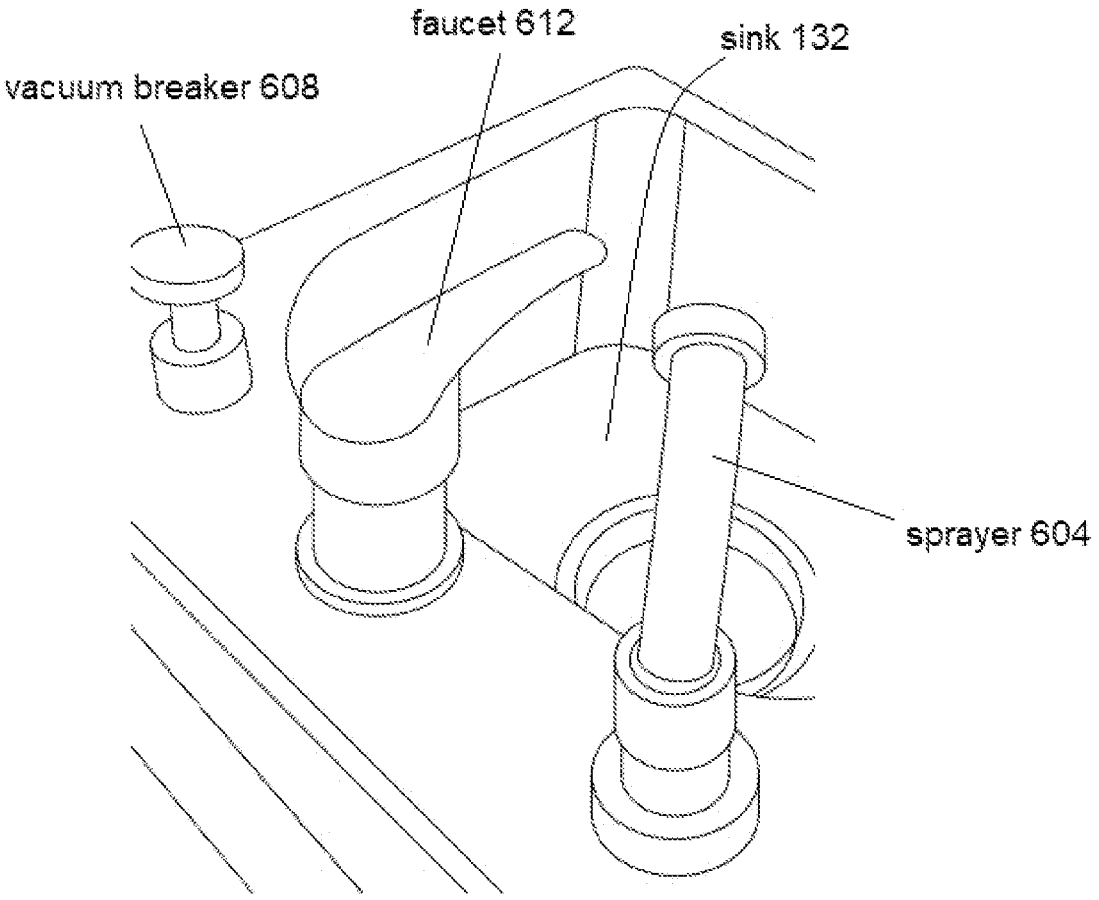
FIG. 6 shows an example location for a vacuum breaker and a spray nozzle.

FIG. 3 shows a drain 304 within the rinse bowl 204 (shown in an underside-view), and also shows a tilt-adjustment 320 as does FIG. 5. FIG. 4 shows the drain 304 and a height-adjustment 404. FIG. 6 (spray-vacuum) shows where the vacuum breaker 608 and the spray nozzle 604 may be located, along with the faucet 612. However, all of this positioning is for example only, and the embodiments herein should not be considered as limited exclusively thereto.

Figure 7:
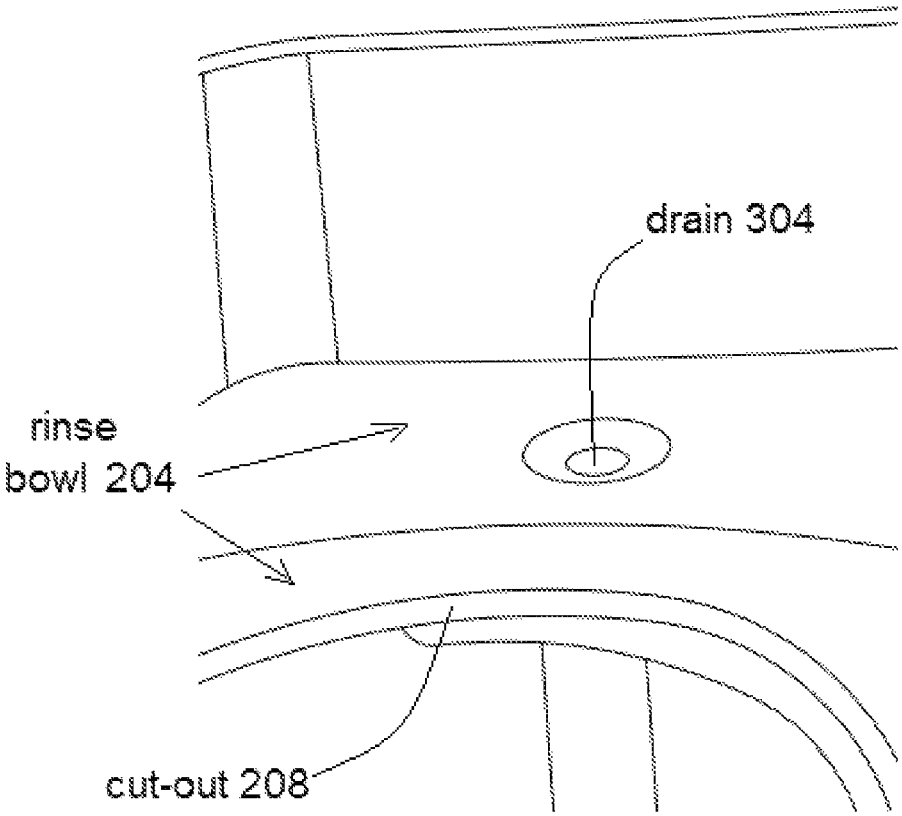
FIG. 7 shows what the rinse bowl looks like from the PoV of a bearded customer.
Figure 8:
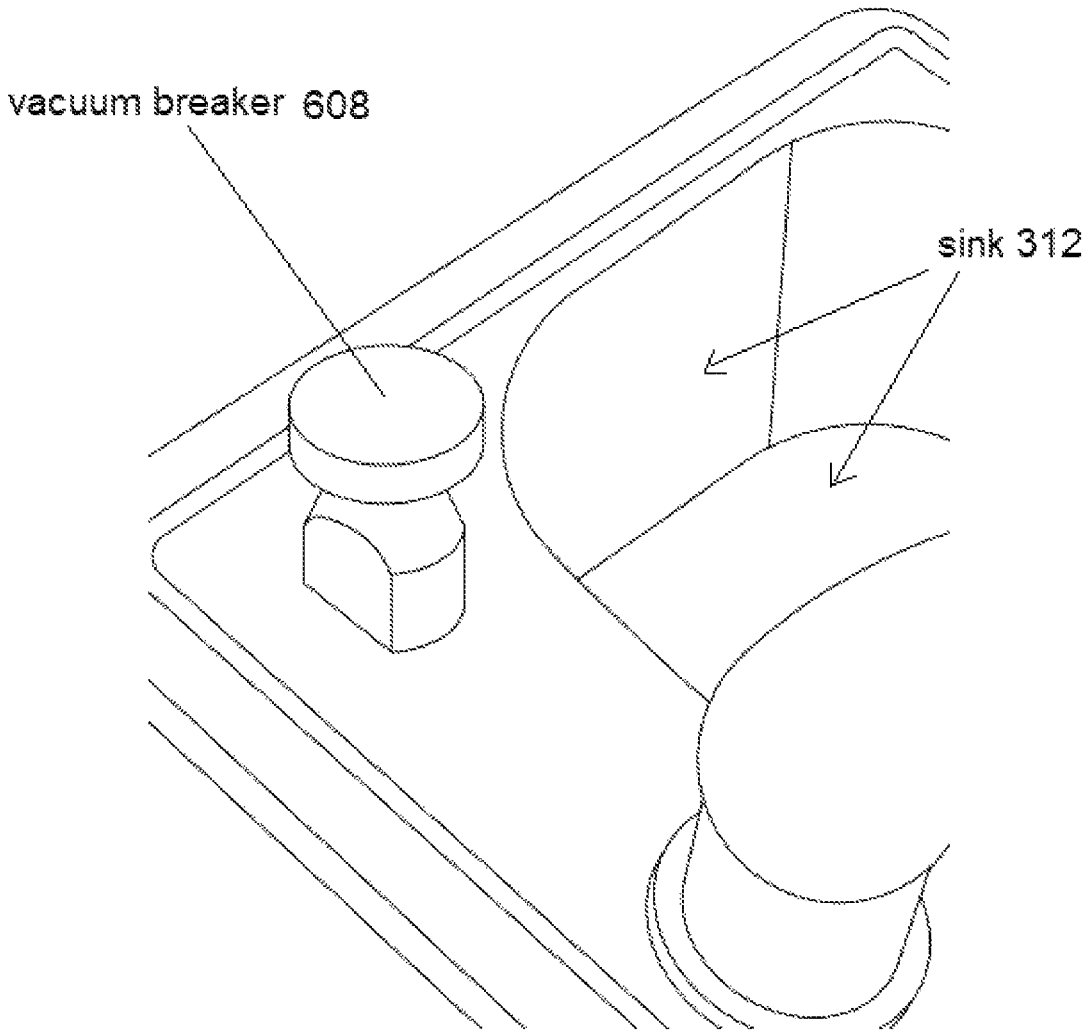
FIG. 8 is a view of a vacuum-breaker.

FIG. 7 (user-view) shows what the rinse bowl 204 may look like for a bearded customer about to undergo some type of rinse. FIG. 8 (vacuum-breaker) is a closer view of the vacuum-breaker 608. The stainless sink 132 is equipped with the vacuum breaker 608 due to being required by plumbing codes, and also includes an extended hose for the spray-nozzle 604.

Marketplace Considerations

The various system(s) 100 described herein can be marketed and sold as beard shampoo/color station. One potential target marketplace would be barber shops and beauty salons. As the embodiments herein would increase the services the shops and salons would be able to offer. Other marketplace considerations including providing the system 100 in a barrel-shaped enclosure (e.g. FIGS. 16A-16B), having smaller/larger embodiments of the cabinet 116 beyond what is shown in FIGS. 1A 1B, e.g. a Japan-sized model where spacing is very compressed.

Other Advantages

Figure 16A:
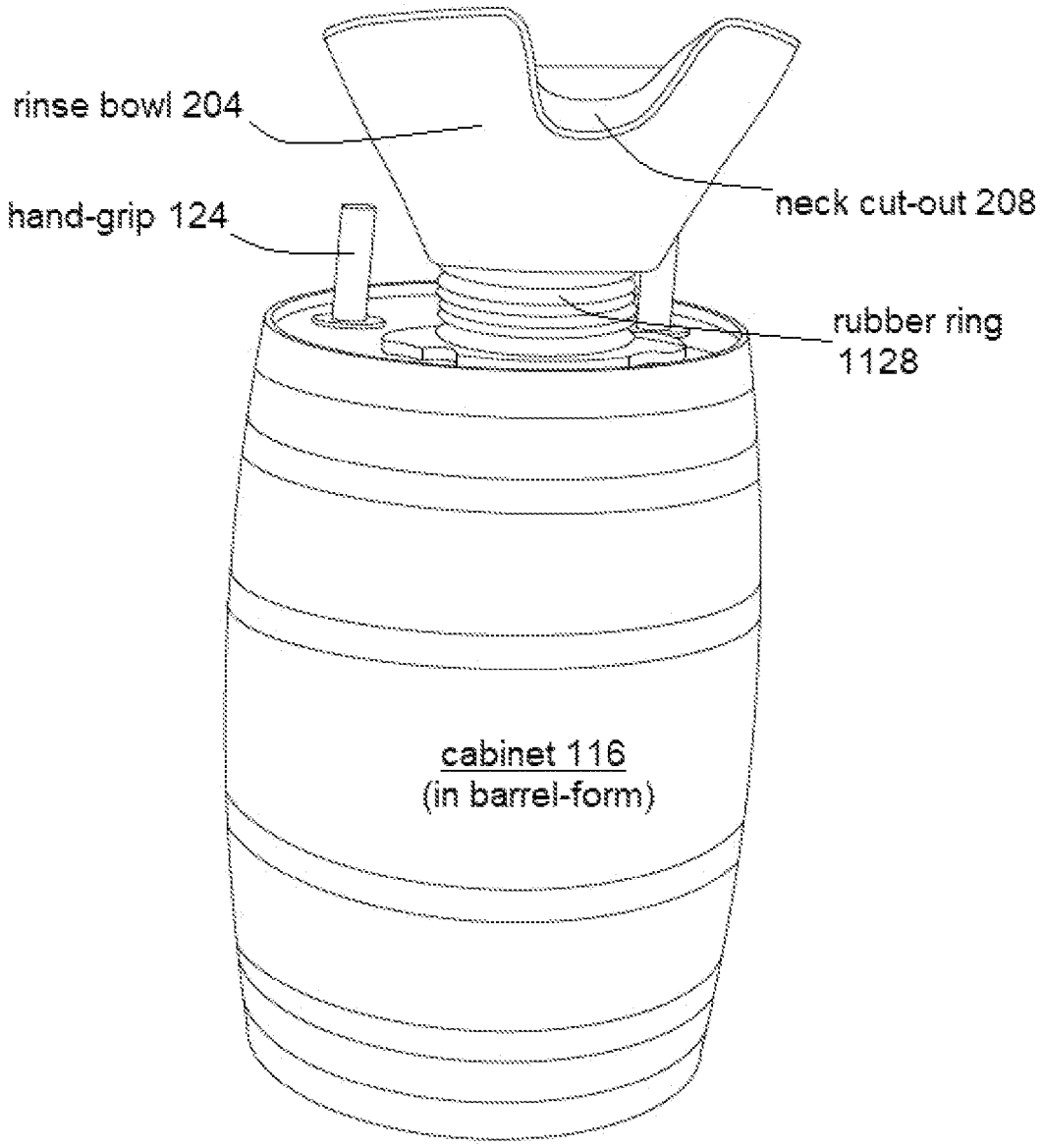
FIGS. 16A-16B show a barrel-style configuration.
Figure 16B:
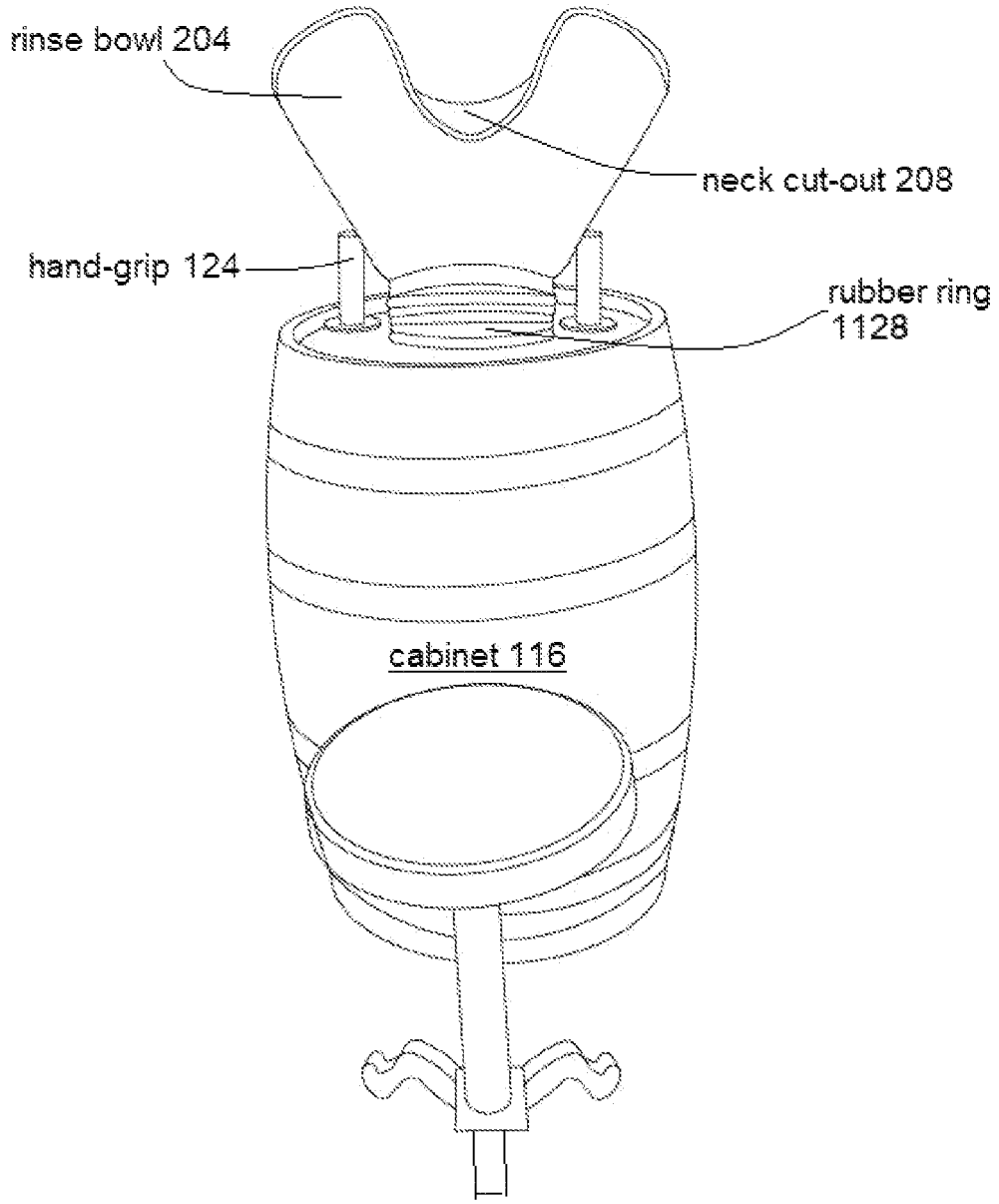

The system 100 and in particular the base cabinet 116 can be custom-designed custom to match any décor, for example including a whiskey-barrel model (an appropriate title for this might be "whisker barrel"), as shown at least within FIGS. 16A-16B. Further, the system 100 is priced to be in-line with most beauty salon equipment/furniture. Although a potential target audience is barbershops, potential home-use is foreseeable. A home-use adaptation would not be difficult, not much more than some other conventional kitchen and plumbing repairs, roughly on par with putting in a dishwasher.

Structural Considerations

In an embodiment, the rinse bowl 204 and the cut-out 208 for neck is heat/vacuum formed, where the rounded edge (especially within the neck out-out 208) allows for enhanced customer comfort. Further, the rinse bowl 204 can be arranged in sizes of (at least) small neck, normal neck and large neck cut-outs 208. This allows the barber/stylist to achieve convenient changing for any neck size.

In an embodiment, a quick release drain hose adapter is included, for the connections to the drain 404.

An embodiment of the cabinet 116 comprises laminated wood-like plank material, coated with a polyurethane for a long-lasting look and easy cleaning. Further, an embodiment of the bar top 120 is made from a vinyl material for water-proofing and stain-proofing, which also facilitates easy cleanup.

Figure 15:
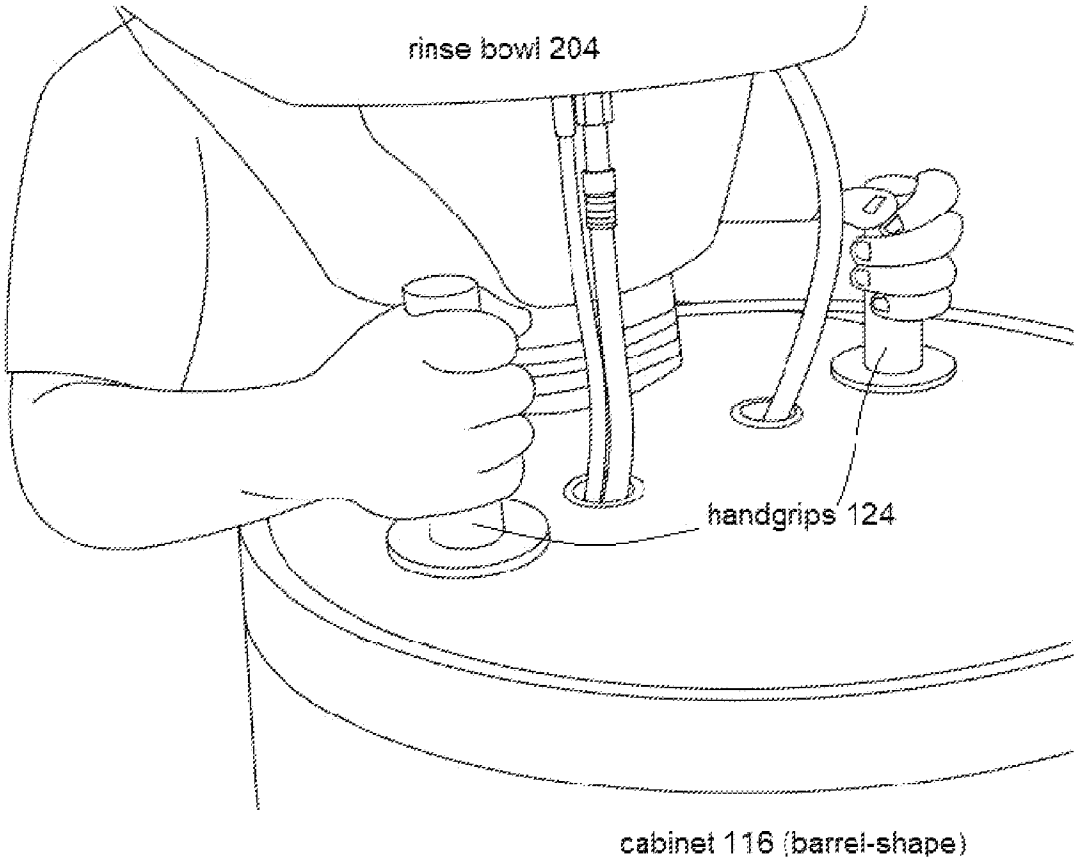
FIG. 15 shows a person sitting within an example system.

As shown at least within FIGS. 2A-2B and 15, the handgrip bars 124 are made from steel and have a rubber comfort grip. These handgrip bars 124 provide a type of weight-balance for bearded customers holding their body slightly forward. This reduces strain on a bearded customer's neck, and helps them hold still and be comfortably weight-balanced to stay firmly yet comfortably within the neck cut-out 208 aperture. Another advantage is avoiding any rinse-water or coloring to leak. The hand grips 124 help make the system 100 easier on the bearded customer's back and neck.

Within the systems 100, the sink portion 132 (not to be confused with the rinse bowl 204) provides substantial convenience for quick nearby cleanup of color bowls, color bottles, brushes, combs or any other tools needed in the service process.

The design of the systems 100 leans towards an industrial tone, although that is not required. The one inch steel rivets provide a type of masculine appeal.

Figure 11A:
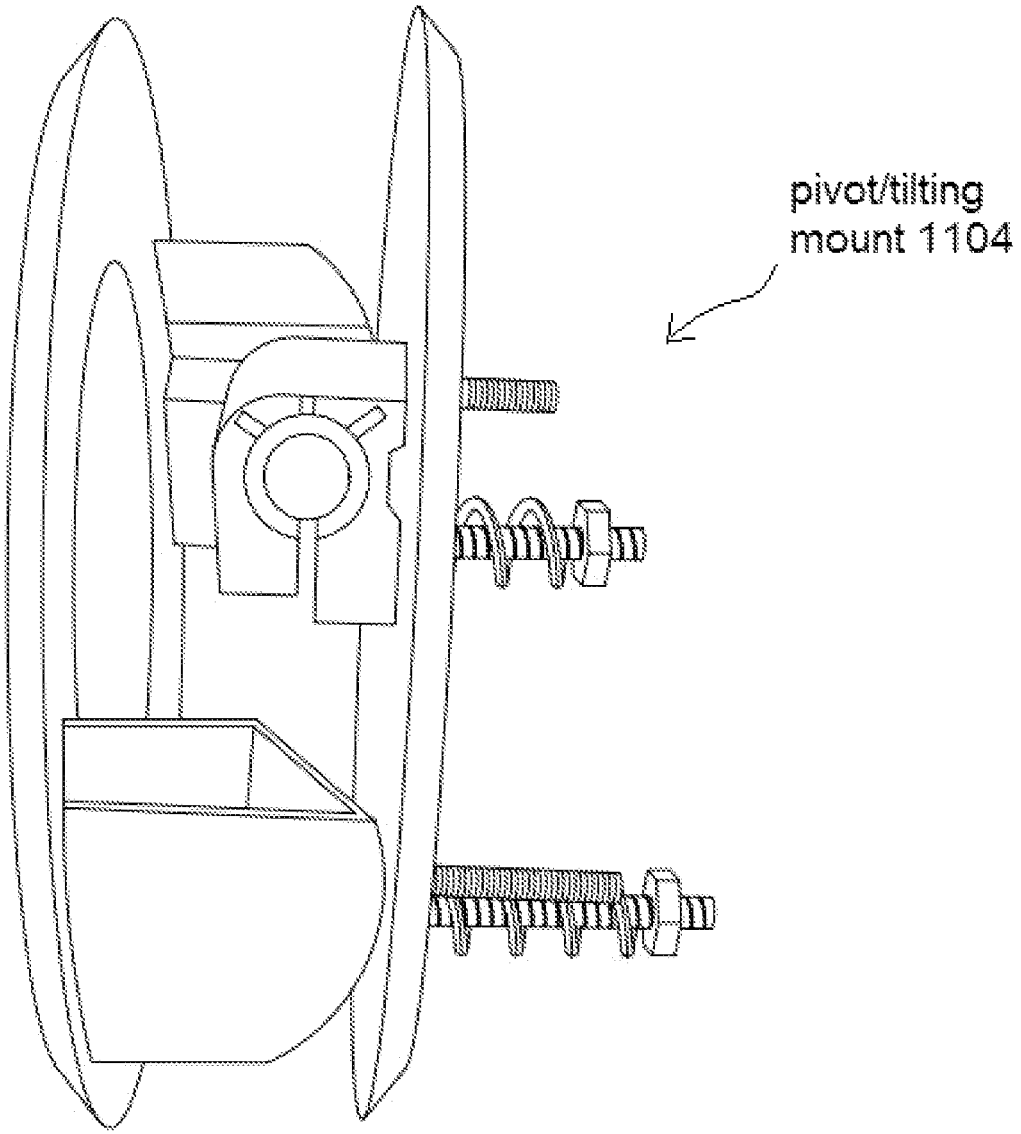
FIGS. 11A-11B show an example tilt\pivot mount.
Figure 11B:
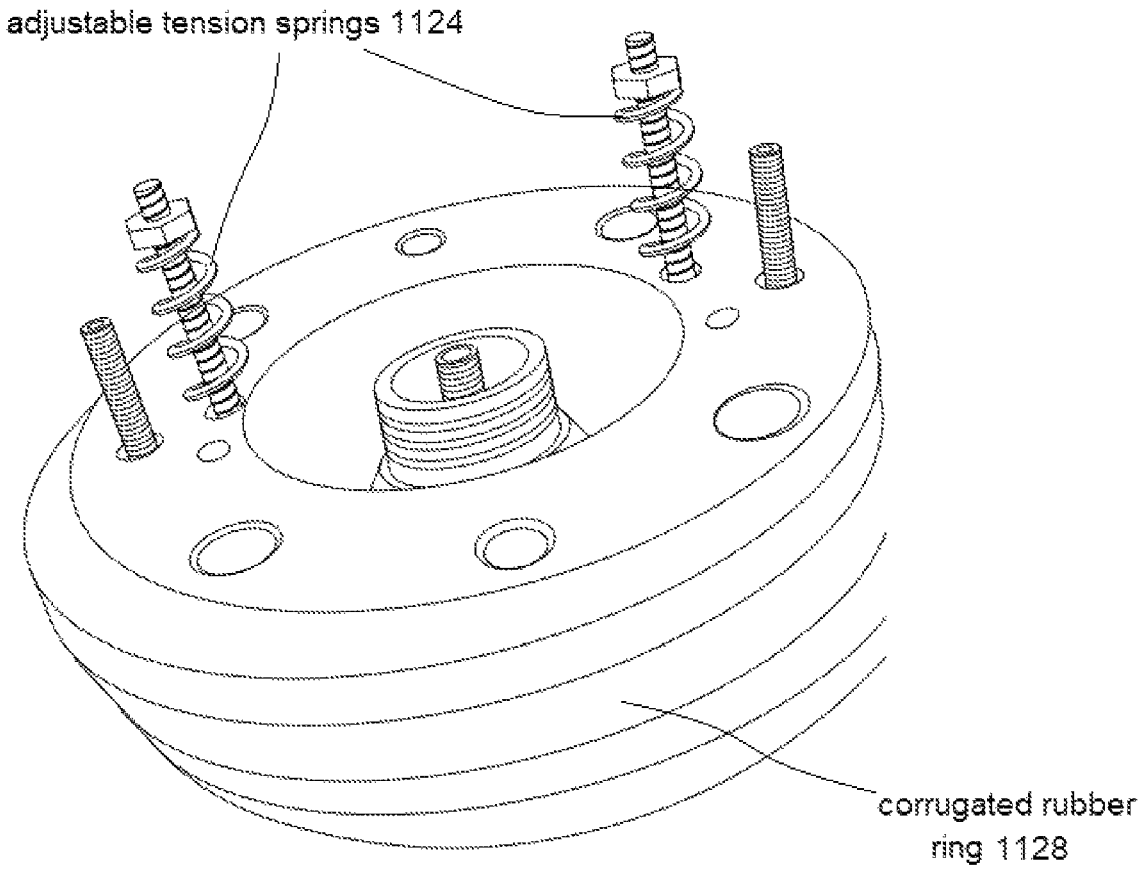

FIGS. 11A-11B show the tilt\pivot mount 1104, which in an embodiment can be made from 1/16" metal with nylon hinges over a pivot pin. One purpose of the tilt\pivot 1104 mount is to allowing for up and down motion of the system 100. The adjustable tension springs 1124 allow the barber to determine how hard or soft they want their tilt\pivot movement to be. This adjustability also acts to reduce stripping of threads.

Figure 12A:
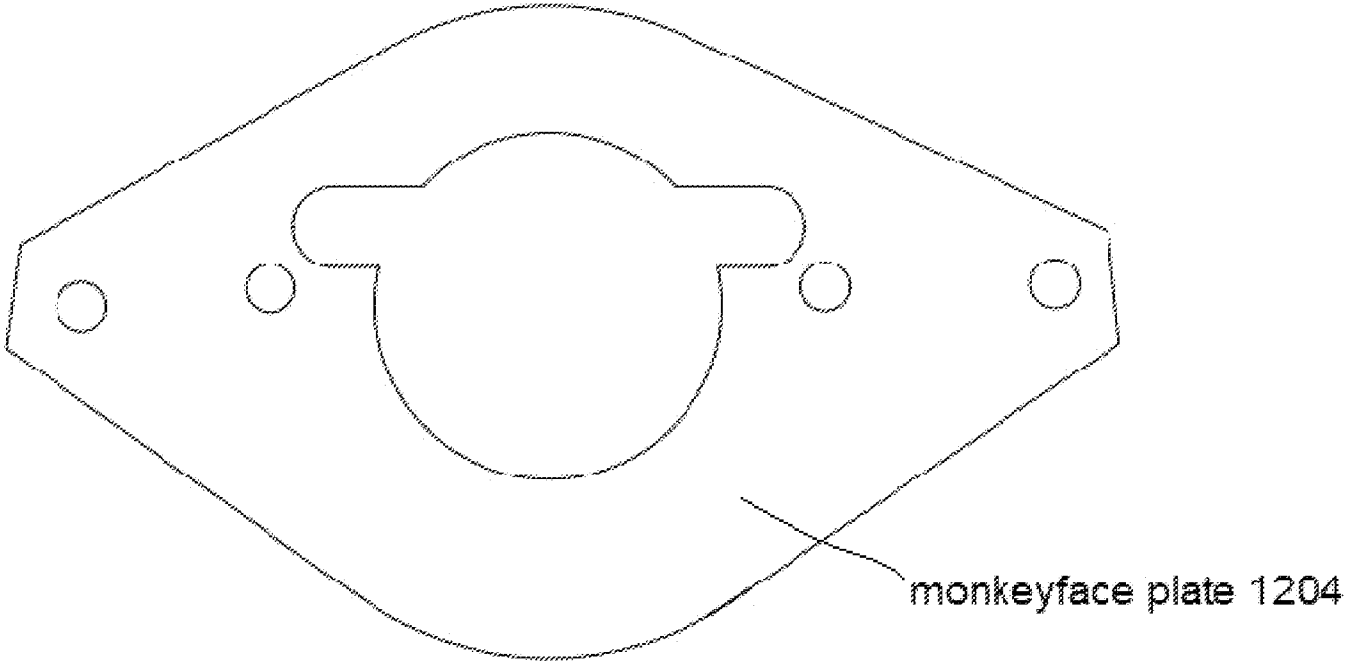
FIGS. 12A-12B shows a monkeyface plate and various details.
Figure 12B:
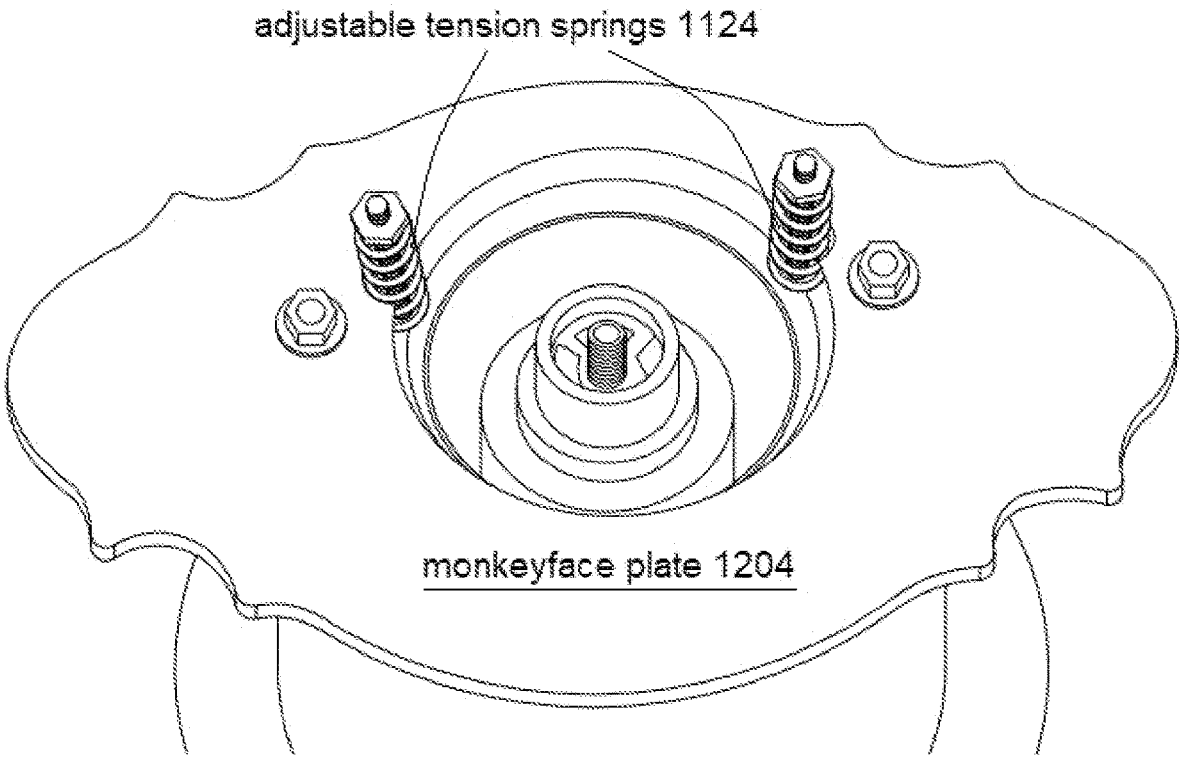

FIGS. 12A-12B shows the monkeyface plate 1204 used for mounting the rinse bowl 204 to the base cabinet 116 in whatever format. The monkey face plate 1204 can be machined from e.g. quarter inch steel, but also can be made from other materials such as wood, plastic, or aluminum. The monkeyface plate 1204 plays an important part in the construction, manufacturing, and assembly of most of the various embodiments herein.

Figure 13A:
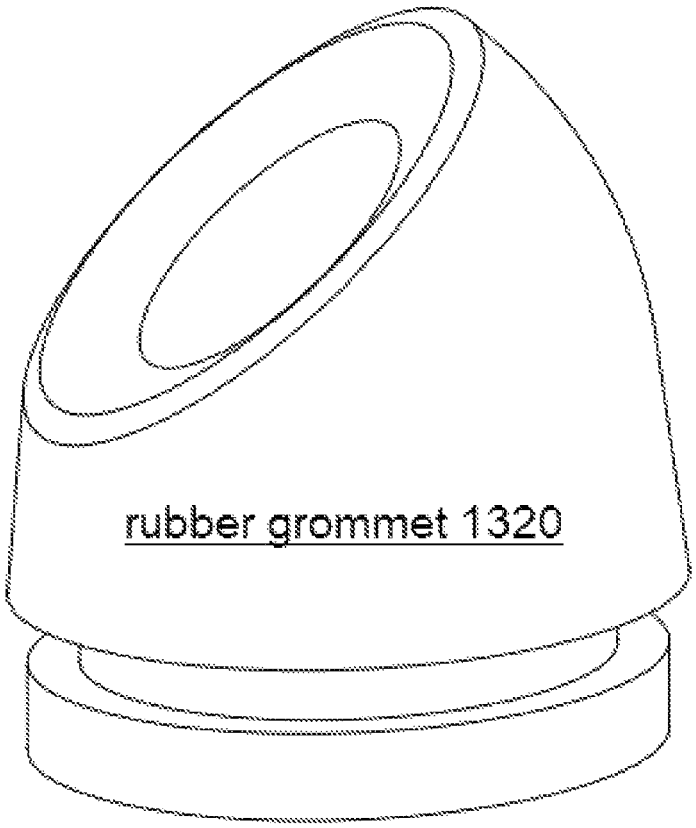
FIG. 13A shows a rubber grommet.

FIG. 13A shows a rubber grommet 1320, which is suitable for holding the sprayer 604.

Figure 13B:
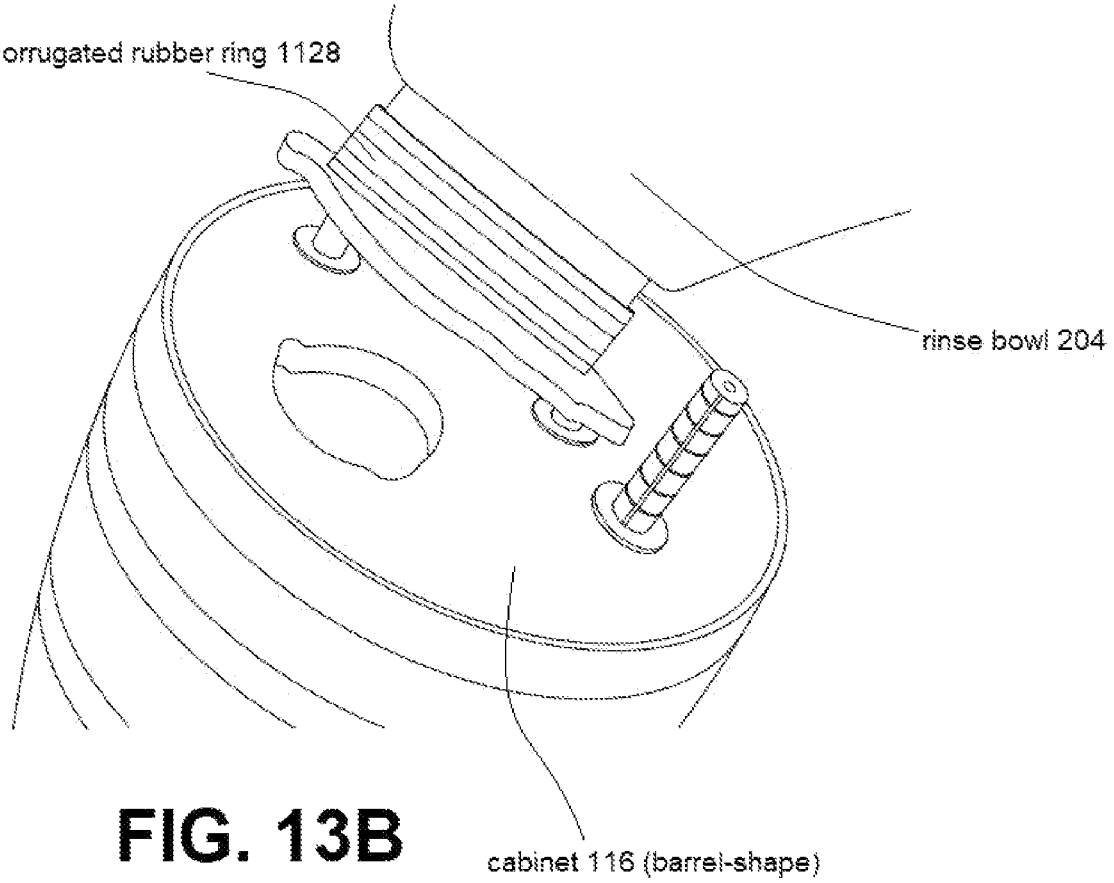
FIG. 13B show an example mounting of a rinse bowl to a base cabinet.

FIG. 13B shows mounting the rinse bowl 204 to the cabinet 116 (whether barrel-shaped or otherwise). However, other stationary surfaces such as counters (e.g. FIGS. 1A-1B) and steel barrels can also be used so that the wooden barrels shown herein are exemplary only. The embodiments herein should not be considered as limited exclusively there too.

Figure 14:
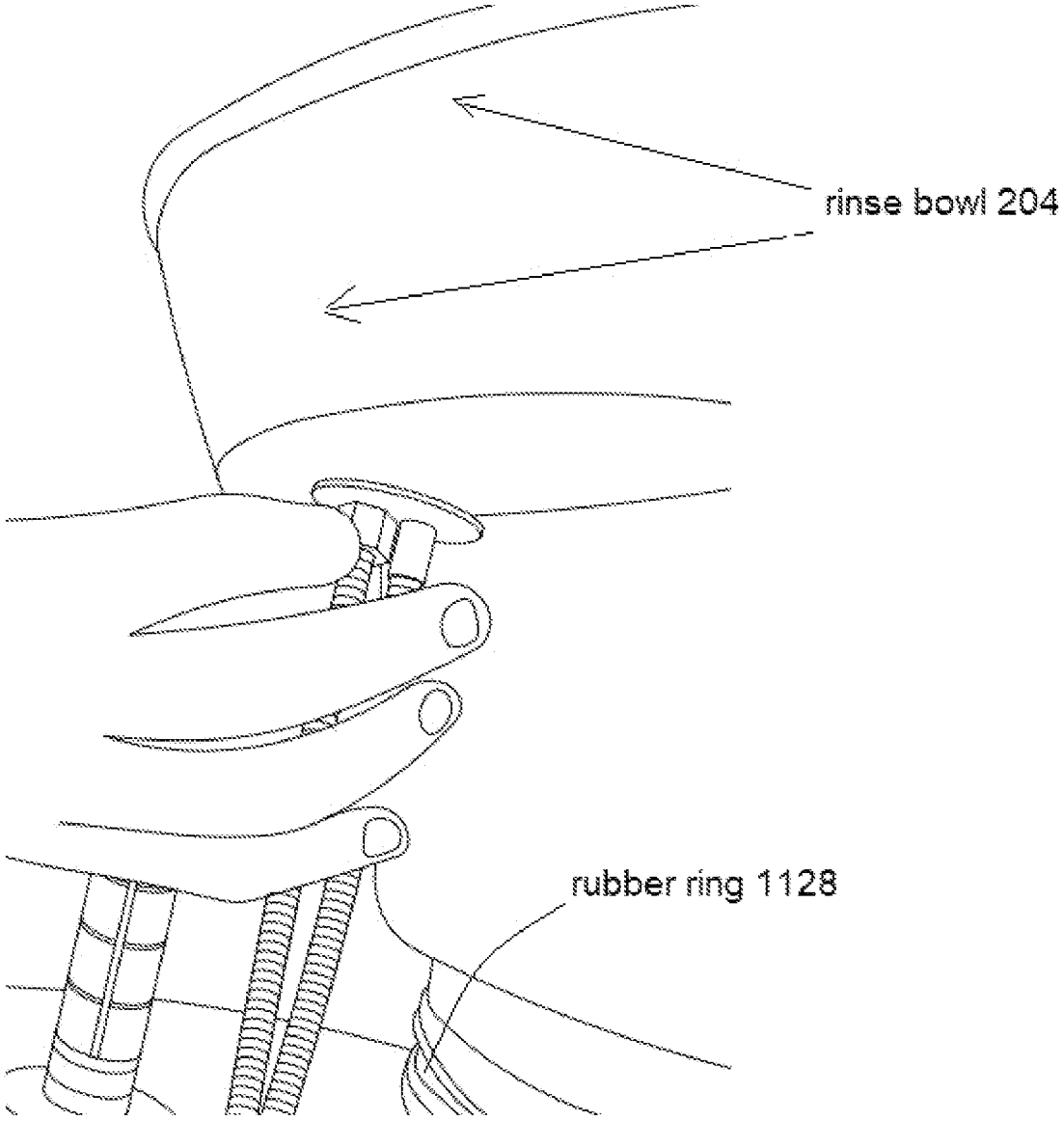
FIG. 14 shows an underside view of a rinse bowl.

In a barrel-embodiment of the system 100, the spray nozzle and faucet 612 are connected directly to the rinse bowl 204, and not to any base cabinet 116. In this case the barrel is the base cabinet 116. Accordingly, FIG. 14 also shows the tubing for the sprayer nozzle 604 and faucet 612 being attached to the rinse bowl 204, in an underside view.

FIG. 15 shows a bearded customer sitting in the system 100 and a underneath view of the attachment hoses for the drain connects to the rinse bowl 204. FIG. 15 also shows a seated bearded customer gripping the two vertical grip bars 124, which provide a sense of comfort and also maintain a suitable ergonomic backside/bodyweight balance their body orientation within the various system(s) 100.

Figure 18:
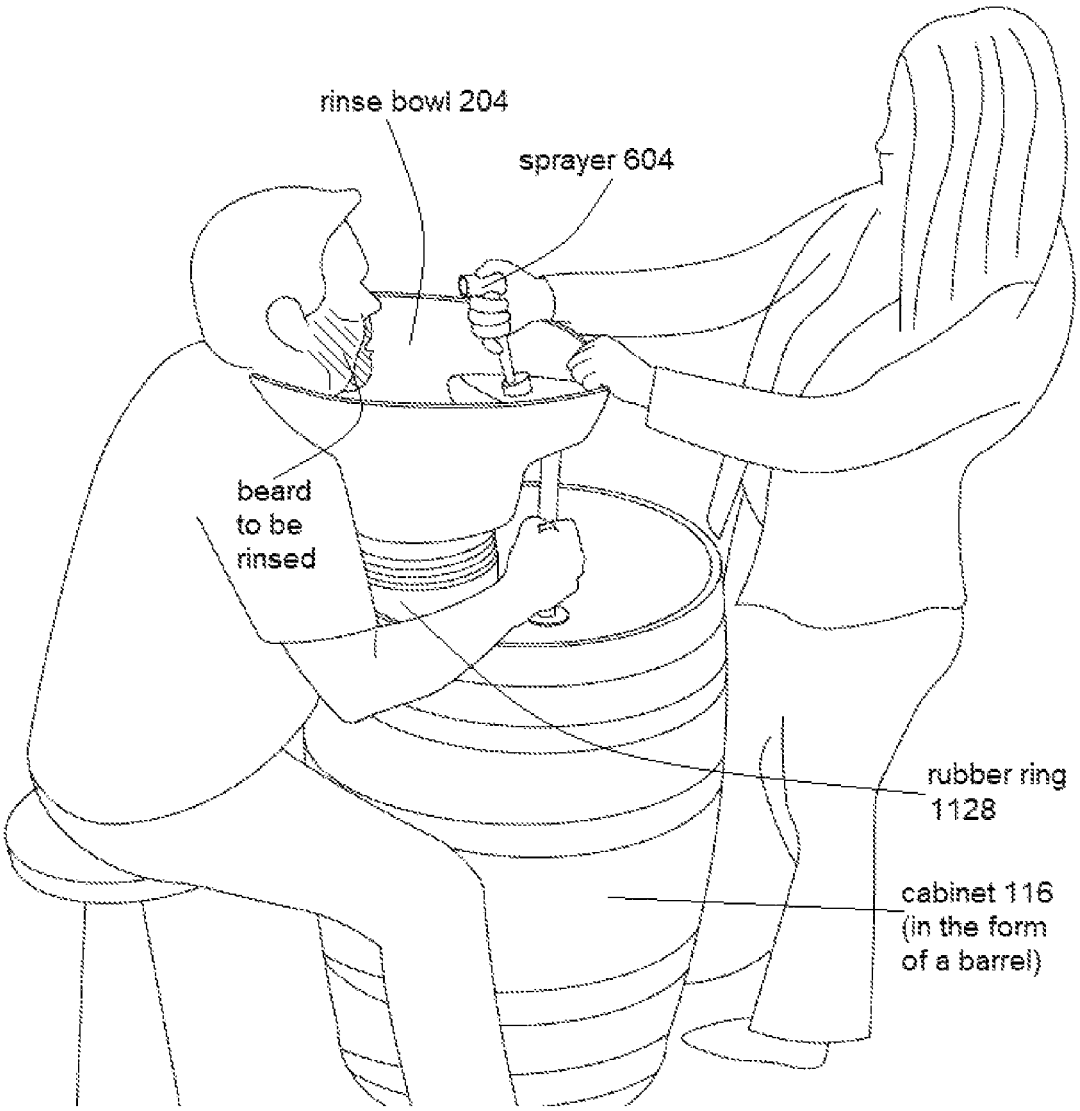
FIG. 18 shows a potential usage-embodiment of the barrel-style configuration with both a stylist and a bearded customer.

FIGS. 16A-16B show example barrel-style configurations, FIG. 16B including a sitting stool for the bearded customer. FIGS. 17A-17B show a portable configuration of the rinse bowl 204, that can be moved around and re-located. FIG. 18 shows a potential usage-embodiment of the barrel-style configuration with both a stylist and a bearded customer.

Assembly Instructions (Non-Limiting, Examples—Only)

Example methods of assembly of the various system(s) 100 will now be presented, with some illustrations using a whiskey barrel as an example base cabinet 116 (in contrast to FIGS. 1A-1B). For clarity and brevity, numerous helpful steps are not discussed herein. As such, the embodiments herein should not be considered as limited exclusively to what is overtly stated herein, but instead the following should be used as an overview.

assembling the drain basket 904 (FIGS. 9-10);
assembling the tilting mechanism 1104;
attaching the pivot/tilt mechanism 1104 to the sink;
installing monkey face plate 1204;
installing the rinse bowl 204; and
mounting the monkeyface plate 1204.

Figure 9:
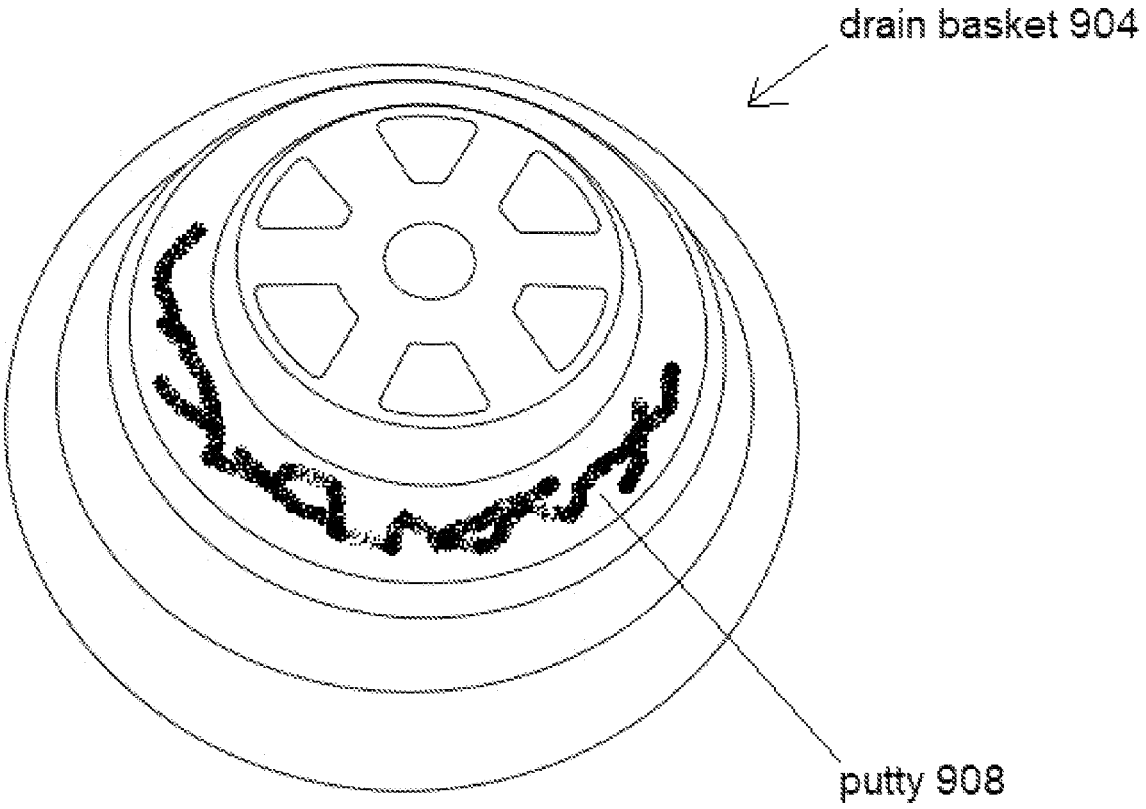
FIGS. 9 and 10 show various assembly principles.
Figure 10:
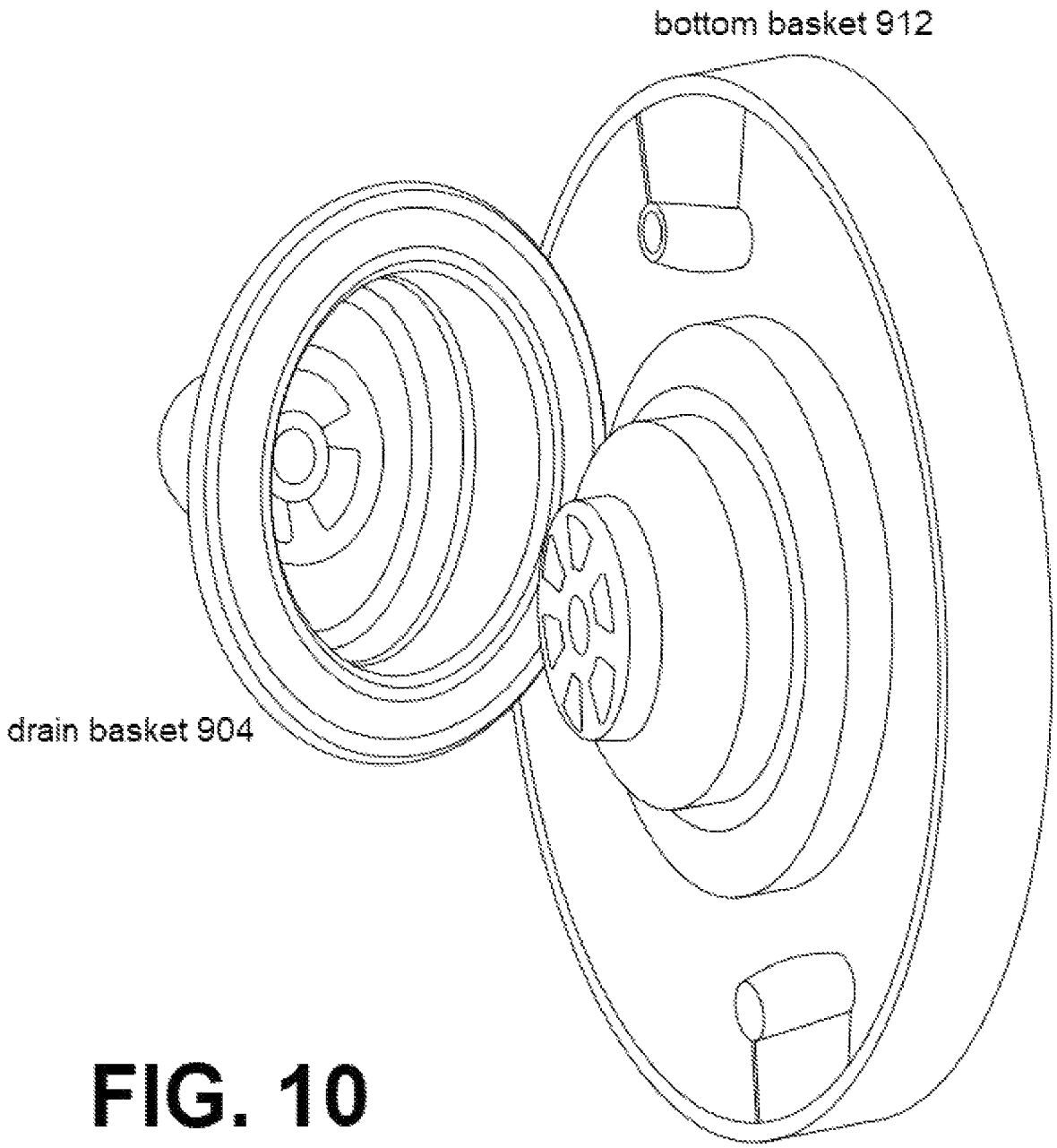

Assembling the drain basket 904 of the neck bowl 204 (FIGS. 9-10);

1) apply plumbers' putty 908 to one side of the drain basket 904;
2) insert a rubber washer into a groove of the bottom basket 912;
3) connect the rubber washer to the drain basket 904;
4) insert a hollow screw into the drain 304 from upwards, meaning downward into the drain basket 904, thereby connecting the drain 304 and the drain basket 904; and
5) tighten the hollow screw to secure.

The above completes the sink drain basket.

Assembling the pivot\tilt mechanism 1104;

As shown in FIG. 13B, put the corrugated rubber ring 1128 over the pivot-tilt mount 1104 for appearance and safety.

Attaching pivot/tilt mount 1104 to the rinse bowl 204;

Locate a plurality of brass embedded grommets onto the lower part of the rinse bowl 204, and screw the tilting mechanism 1104 into these grommets. A long-bladed screwdriver may be required to reach the grommet holes.

Install monkey face plate 1204 onto the rinse bowl 204;

1) place screws into in the screw holes, e.g. 2 washers and 2 nuts (one on each screw);
2) tighten until secure;
3) insert a rubber washer into the flexible drain hose, and
4) screw into drain basket (located in the center of the under part of the rinse bowl 204).

Installing the rinse bowl 204 onto the cabinet 116;

Fasten a stink-tube to the cabinet 116 (e.g. barrel or otherwise) using e.g. lag bolts on each side of the monkeyface mounting plate 1204.

While preferred embodiments of the present invention have been shown and described herein, it will be obvious to those skilled in the art that such embodiments are provided by way of example only. It is not intended that the invention be limited by the specific examples provided within the specification. While the invention has been described with reference to the aforementioned specification, the descriptions and illustrations of the embodiments herein are not meant to be construed in a limiting sense. Numerous variations, changes, and substitutions will now occur to those skilled in the art without departing from the invention. Furthermore, it shall be understood that all aspects of the invention are not limited to the specific depictions, configurations, or relative proportions set forth herein which depend upon a variety of conditions and variables. It should be understood that various alternatives to the embodiments of the invention described herein may be employed in practicing the invention. It is therefore contemplated that the invention shall also cover any such alternatives, modifications, variations, or equivalents. It is intended that the following claims define the scope of the invention and that methods and structures within the scope of these claims and their equivalents be covered thereby.

B-TEAM APPENDIX (Part of Specification, not Part of Claims)

constructing the base cabinet from laminated wood-like plank material, coated with a polyurethane for a long-lasting look and easy cleaning;

making the bar top from a vinyl material for water-proofing and stain-proofing;

Assembling the drain basket 904 of the neck tray 204 (FIGS. 9-10)

1) apply plumbers' putty to one side of the drain basket;
2) insert a rubber washer into a groove of the bottom basket;
3) connect the rubber washer to the drain basket;
4) insert a hollow screw into the drain from upwards, meaning downward into the drain basket, thereby connecting the drain and the drain basket; and
5) tighten a hollow screw to secure the drain basket.

Attaching pivot/tilt mechanism 1104 to the rinse tray 204 locating a plurality of brass embedded grommets onto the lower part of the rinse tray, and screw the tilting mechanism 1104 into them;

Installing the rinse tray 204

Fasten a stink-tube to the cabinet 116 (e.g. barrel or otherwise) using e.g. lag bolts on each side of the monkey-face mounting plate 1204.

X. The method of claim X, further comprising:

during the installation of the monkey face plate, 1) place screws into in a plurality of screw holes within the monkey face plate, positioning the monkey face plate on one of the plurality of base cabinets designs, and tightening the screws until secure;
3) insert rubber washer XXX into the flexible drain hose XXX, and
4) screw into sink drain basket (located in the center of the under part of the sink).

X. The method of claim X, further comprising:

making the tilt\pivot mount from metal with nylon hinges over a pivot pin;

9. The method of claim X, further comprising:

positioning the corrugated rubber ring over the tilt-pivot mount.

X. The method of claim X, further comprising:

positioning a protective rubber grommet around the body of a/the sprayer;

What is claimed is:

1. A method of constructing an elevated beard-rinsing system, comprising:

locating a rinse bowl in an elevated position from a base cabinet;

locating a spray nozzle adjacent to the rinse bowl;

configuring the rinse bowl with a cut-out for a neck of a user, and positioning hand grips on a upper surface of the base cabinet;

configuring the rinse bowl to have a pivot/tilt mount;

assembling the pivot/tilt mount;

attaching the pivot/tilt mount to the rinse bowl;

fixedly\securely connecting the rinse bowl and the pivot/tilt mount to the base cabinet using a monkey face plate;

the monkey face plate stabilizing the system such that the rinse bowl can be tilted and pivoted according to physical characteristics of both a bearded customer and a stylist and yet the rinse bowl remaining securely connected to the base cabinet;

positioning\configuring a pivot knob beneath a rinse tray and connected to the tilt-pivot mount configured for the stylist to make pivoting adjustments to the rinse tray, wherein the stylist loosens the pivot knob to make pivoting adjustments and tightens the pivot knob to secure the adjustments.

2. The method of claim 1, further comprising:

configuring the rinse bowl to have a drain connection for evacuating water from the spray nozzle; and connecting the drain connection within the rinse bowl to a base-drain within the base cabinet using a drain basket.

3. The method of claim 1, further comprising:

configuring the tilt-pivot mount with adjustable tension springs.

* * * * *